US007332714B2

(12) United States Patent
Watanabe et al.

(10) Patent No.: US 7,332,714 B2
(45) Date of Patent: Feb. 19, 2008

(54) QUADRUPOLE MASS SPECTROMETER AND VACUUM DEVICE USING THE SAME

(75) Inventors: Fumio Watanabe, Ibaraki (JP); Reiki Watanabe, Ibaraki (JP)

(73) Assignee: Vaclab Inc., Ibaraki (JP)

( * ) Notice: Subject to any disclaimer, the term of this patent is extended or adjusted under 35 U.S.C. 154(b) by 190 days.

(21) Appl. No.: 11/375,063

(22) Filed: Mar. 15, 2006

(65) Prior Publication Data

US 2006/0226355 A1 Oct. 12, 2006

(51) Int. Cl.
*H01J 49/42* (2006.01)
*H01J 49/28* (2006.01)

(52) U.S. Cl. ..... 250/283; 250/281; 250/286; 250/423 R; 250/427; 250/396 R; 250/397

(58) Field of Classification Search ..... None
See application file for complete search history.

(56) References Cited

U.S. PATENT DOCUMENTS 6,040,575 A * 3/2000 Whitehouse et al. ..... 250/288
6,204,500 B1 * 3/2001 Whitehouse et al. ..... 250/287

FOREIGN PATENT DOCUMENTS

JP 7-37547 2/1995

* cited by examiner

*Primary Examiner*—Nikita Wells
(74) *Attorney, Agent, or Firm*—Takeuchi & Kubotera, LLP

(57) ABSTRACT

In a quadrupole mass spectrometer which measures partial pressure strength according to a gas type in a vacuum system from ion current intensity, a quadrupole mass spectrometer with a total pressure measurement electrode has a total pressure measurement electrode for examining an ion density disposed in a demarcation space which is comprised of a grid electrode and an ion focusing electrode. And, a vacuum system is provided with only the quadrupole mass spectrometer which measures partial pressure strength according to a gas type in the vacuum system from an ion current intensity and does not have an ionization vacuum gauge other than the quadrupole mass spectrometer.

7 Claims, 13 Drawing Sheets

QUADRUPOLE MASS SPECTROMETER AND VACUUM DEVICE USING THE SAME

TECHNICAL FIELD

The present invention relates to an ionization vacuum gauge for measuring a gas molecular density, namely a pressure, of gas molecules within a vacuum device, and a quadrupole type mass spectrometer for similarly measuring a molecular density of gas molecules according to a type of gas by mass spectrometry.

BACKGROUND ART

This type of quadrupole type mass spectrometer is sometimes called by another name, such as a residual gas analyzer, a partial pressure gauge or a mass filter. A conventional quadrupole type mass spectrometer will be described with reference to FIG. 10.

As a method for measuring a gas density (pressure) remaining in a vacuum device 9 in FIG. 10, it uses a total pressure gauge G for measuring the total pressure and a partial pressure gauge Q' for measuring a density by a type of gas, and the vacuum device 9 is generally provided with both of them.

At present, it is general to use an ionization vacuum gauge (G) as the former total pressure gauge capable of measuring a whole region of high vacuum, ultrahigh vacuum and extra-high vacuum, and a quadrupole type mass spectrometer (Q'), which is provided with an electron impact ion source, as the latter partial pressure gauge. Both of them generally have a hot cathode type filament for an electron emitter.

In the ionization vacuum gauge G (Beyard-Alpert type ionization vacuum gauge, hereinafter referred to as "BA type" in FIG. 10), electrons emitted from a hot cathode filament (hereinafter referred to as "filament") 3' which is biased 33' from ground potential to positive electric potential between 20 to 100 volts are accelerated toward a grid electrode 2' which is biased 22' to an electric potential much higher by about 120 volts than the filament's potential, passed through the grid electrode 2' after having been accelerated, reflected on the other side after having passed through, and oscillate inside and outside of the grid electrode 2'. In the process of oscillation, the electrons partly collide with the grid electrode 2' and are absorbed by it. At this time, the electrons lost by the grid electrode 2' are always compensated from the filament 3', so that the constant electrons are always oscillated within and outside of the grid electrode in the ionization vacuum gauge G.

The oscillating electrons collide with the residual gas molecules in the vacuum device 9 flowed into the grid electrode to generate positive ions within the grid electrode. The positive ions are collected to a needle shape collector electrode 7' and flowed into an electro-meter 8' held at the ground potential, and the intensity is measured. This current is proportional to residual gas molecular density (pressure) P, and ion current (signal current) $I_i$ to P is expressed as follows:

$$I_i = SI_eP \qquad \text{Equation (1)}$$

where, S ($Pa^{-1}$) is a proportional constant which is called a sensitivity coefficient, and $I_e$ is electron beam current which collides with the grid electrode. In other words, the pressure in the vacuum device can be determined by measuring $I_i$.

Meanwhile, in a case of the quadrupole mass spectrometer Q', an ion source 10 is constructed with an ion focusing electrode 4, a grid electrode 2 and the hot cathode filament 3. The ion source 10 has an open-end-cylindrical (BA type) grid and a plate ion focusing electrode 4, which has a hole slightly larger than the diameter of the grid and which is formed at the center, disposed to form a demarcation space A.

Besides, a total pressure measuring electrode 5' which has a hole r slightly smaller than the hole h of the ion focusing electrode is disposed outside of the ion focusing electrode 4 and connected to an electrometer 50 through a vacuum terminal on the atmosphere side. In other words, in the quadrupole mass spectrometer Q', the total pressure measuring electrode 5' provides the same role as the collector electrode 7' of the ionization vacuum gauge G.

The ions produced in the demarcation space A are attracted to and focused to the ion focusing electrode 4, accelerated toward the total pressure measuring electrode 5', and partly lost by colliding to the total pressure measuring electrode 5'. The remaining beam current passes through the center hole r formed in the total pressure measuring electrode 5, and flowed as ion beam B to the other side. Therefore, where an electrical lead 51 is connected to the total pressure measuring electrode 5' and also connected to the electrometer 50 which is held at a ground potential, the pressure in the vacuum device 9 can be determined from the remained (1−k) ion current by subtracting a ratio k (k<1 here) flowed as the ion beam B by the following Equation in the same manner as the ionization vacuum gauge G.

$$I_i' = (1-k)SI_eP \qquad \text{Equation (2)}$$

The ions taken out as the ion beam B at the ratio k enters a quadrupole mass analyzing portion 6 (hereinafter referred to as "quadrupole"), separated depending on the mass of the ions, entered into a detector 7, i.e. electron multiplyer, and determined for a strength by mass by an electrometer 8.

But, the ion transmittance through a quadrupole 6 is only about several percents of that of incident ions (ions of the same mass), so that the separated ion current becomes very small. Where a pressure is high and ion current is large enough, it is possible to measure the current as it is by the electrometer 8. But, if the pressure lowers and the ion current intensity becomes $10^{-10}$ A or less, amplification of the electrometer becomes difficult. In this case, ion beam B' is connected to a secondary electron multiplier E which is disposed within the detector 7 which converts the ion beam B' into an electrical signal, thereby to amplify the ion beam B' to 100 to 10000 times for once on the vacuum side by using the electron avalanche phenomenon, and after the amplification, it is led to the electrometer 8, and an ion current intensity according to the mass is obtained.

Therefore, both a total pressure and a partial pressure can be measured by the quadrupole mass spectrometer Q' only, so that it is not necessary to mount both the ionization vacuum gauge G and the quadrupole mass spectrometer Q' in the vacuum device 9, and the object can be achieved sufficiently by only the quadrupole mass spectrometer Q'. But, it is general to mount both of them on the vacuum device 9. Its reasons will be described separately according to the phenomenon.

The ion beam B from the ion source 10 in FIG. 10 enters the quadrupoles 6, the voltage applied to the quadrupoles 6 varies, only ions corresponding to a detection mass m pass through the quadrupoles 6 and is amplified by the multiplier E, and strength corresponding to the mass m is detected by the electrometer 8. But, the quadrupole mass spectrometer has a drawback that the ion current decreases at a ratio of 1/m to $1/\sqrt{m}$ as the mass number m increases. Besides, an amplification factor of the multiplier E also tends to decrease as the mass number m increases. Because of the two mass differential phenomena, a total of electrometer of the individual spectra obtained from the electrometer 8 and the value of the total pressure electrometer 50 are largely different depending on the gas compositions and are not in a proportional relationship.

In addition, where the multiplier is used in the detector 7, a multiplication factor lowers depending on bakeout times and a repetition, so that it becomes impossible to understand at all to which pressure the peak intensity obtained from the spectrum of the quadrupole mass spectrometer Q' corresponds in terms of the absolute pressure (an intensity ratio between the individual spectra involved in the pressure change is same). What assists it is an ion current signal which is obtained through the total pressure measuring electrode 5', an absolute pressure is read by the total pressure measurement, and it is necessary to keep compensating the gas composition ratio of the absolute pressure, and the quadrupole mass spectrometer Q' is provided with the total pressure measuring electrode 5'.

Because, the object of the quadrupole mass spectrometer Q' is gas analyzing, and effectively usable ion current is a ratio k (about k<½ here) of the generated ions in the ion source and becomes much smaller by passing through the quadrupoles 6, so that it is necessary to increase the ion transmittance k of the generated ions in the demarcation space A within the ion source 10 as high as possible. Therefore, the ion source 10 which is mounted on the conventional quadrupole mass spectrometer Q' needs to adjust the potential of the ion focusing electrode 4 to the optimum value. At that time, the ion transmittance k changes, and it becomes impossible to determine the true pressure by the Equation (2).

In addition, an ion distribution density generated in the demarcation space A formed of the grid electrode 2 and the ion focusing electrode 4 changes when the pressure in the vacuum device increases and the ion density increases, and the value (1−k) also changes, and the ion current obtained from the total pressure measuring electrode 5' deviates from the proportional straight line of the pressure.

Besides, there are the following problems. The ion source 10 mounted on the conventional quadrupole mass spectrometer Q' is required to have the grid electrode 2, the ion focusing electrode 4, the total pressure measuring electrode 5' and the quadrupole casing 56 assembled to have a small distance of about 1 mm to 2 mm among them, and individual electric potentials are also different considerably. Therefore, an actual quadrupole mass spectrometer Q' adopts a structure that ceramic washers 52 and the electrodes 2, 4, 5' are alternately stacked on a ceramic pipe 53 to satisfy both a distance and insulation as shown in FIG. 11, and a different bias is applied to the individual electrodes. Generally, the grid electrode 2 is biased to 220V, the ion focusing electrode is biased to 200V, and the total pressure measuring electrode 5' is biased to the same ground potential (0V) as the quadrupole casing 56.

But, alumina ceramic has an insulation resistivity of about $\sigma=10^{14}$ Ω·cm at 20° C., but the temperatures of the electrodes and ceramic parts around the ion source 10 are increased to about 100° C. by heat from the hot cathode filament 3. Therefore, the resistivity of the ceramic lowers to $\sigma=10^{13}$ Ω·cm or less. For example, when it is assumed that the ceramic between the ion focusing electrode 4 and the total pressure measuring electrode 5' has a thickness of 1 mm and supported at three portions, a total area of the washer type ceramic insulator 52 becomes about 1 $cm^2$, and the total resistance becomes $R=1\times10^{12}$ Ω. And, leak current L of about $I=V/R=200/1\times10^{12}=2\times10^{-10}$ A is generated between the ion focusing electrode 4 and the grid electrode 2. Spurious pressure P generated by the leak current L can be calculated by using the Equation (2), and the pressure is expressed as follows when it is assumed that the sensitivity coefficient is $S=1\times10^{-2}$ Pa, electron current is $I_e=2\times10^{-3}$ A, and a ratio of the ion beam B is k=0.7:

$$P=L+[(1-k)SI^e]=2\times10^{-10}+[0.3\times10^{-2}\times2\times10^{-3}]3.3\times10^{-5}\text{ Pa.}$$

It is when the insulating ceramics 52, 53 are completely free from contamination and in an ideally insulated state. In practice, the total pressure which can be measured by using the ion focusing electrode 5' is limited to a high pressure of $10^{-5}$ Pa or more by an influence of the leak current.

Meanwhile, in a case where the total pressure is measured by means of the conventional quadrupole mass spectrometer Q' shown in FIG. 10, there is a problem of a quadrupole fringe field. Among the quadrupoles 6, mutually crossing two are short-circuited to provide two electrodes, these two electrodes have AC voltage of Vcosωt overlapped with ±U DC voltage, scanning is performed depending on the mass m such that U/V becomes always constant (when m is small, U is also small, and when m is large, U also becomes large), and an electric field is accordingly applied to the four quadrupoles 6. Generally, kinetic energies of ions to be entered into the quadrupoles 6 must be decelerated to 10 electron volts or less, so that the center electric potential of the quadrupoles 6 is close to the electric potential of the grid electrode 2, and it is held at electric potential higher by 200V or more than the total pressure measuring electrode 5' of the ground potential. If the analysis mass m is large, a high voltage of about 300 to 400V is present on the back side of the total pressure measuring electrode 5'. Therefore, the ion beam B which has left the ion focusing electrode 4 is once accelerated to the maximum by the total pressure measuring electrode 5', and immediately after the ion beam B passes through the hole r of the total pressure measuring electrode 5', the electric field works so that the ion beam B is reflected at the inlet of the quadrupoles 6.

Therefore, the same ions are partly reflected (hereinafter referred to as "quadrupole fringe field problem") at the inlet of the quadrupoles 6, and the reflected ions from the opposite side of the quadrupoles 6 flow into the total pressure measuring electrode 5'. The reflected amount is variable depending on the mass m, so that there is a large difference in the total pressure measurement depending on the ion compositions.

To solve the above-described quadrupole fringe field problem, a quadrupole mass spectrometer Q" is proposed to disuse the total pressure measuring electrode 5' of FIG. 10 by using an electronic repeller electrode 57 shown in FIG. 12, and it has become known (Japanese Patent Laid-Open Publication No. Hei 7-037547).

But, this known method has more defects than the method using the above-described total pressure measuring electrode 5'. The reasons will be described with reference to FIG. 13 which shows a sectional view of a part of the ion source 10 when the electronic repeller electrode 57 of FIG. 12 is used as a total pressure measurement electrode.

In FIG. 13, the electronic repeller electrode 57 is disposed to surround the cylindrical grid electrode 2 and the circular filament 3. Electrons having come out of the filament 3 are accelerated by the grid electrode 2 to burst out to the opposite side, reflected by the electronic repeller electrode 57 and repeat oscillating in and out of the grid electrode to collide with the gas molecules to produce ions. The ions are generated not only in the grid electrode 2 but also in a portion c between the grid electrode 2 and the electronic repeller electrode 57. The electronic repeller electrode 57 is positioned on a ground level and connected to the electrometer 50. In other words, the ions generated between the grid electrode 2 and the electronic repeller electrode 57 can be pulled toward the electronic repeller electrode 57 to be measured, and this current is proportional to the pressure, so that the same Equation (1) can be used to determine the pressure (the value of sensitivity S is different). It is described in the Japanese Patent Laid-Open Publication No. Hei 7-037547 that because the total pressure can be measured by the electronic repeller electrode 57, an influence of reflecting of the ions by the quadrupole fringe field is not caused, and accurate pressure measurement can be made.

But, the above method also has two great problems. One is that electrons repeat oscillating in and out of the grid electrode 2 but finally collide with the grid electrode 2 as described above. The electrons have an energy of about 120V when they collide with the grid electrode 2, so that a soft X-ray corresponding to about $1/10^5$ of the colliding electrons is generated as x from the surface of the grid electrode 2. This soft X-ray's x is absorbed by the electronic repeller electrode 57 which surrounds it.

But, about 1/100 of the absorbed soft X-ray's x is emitted as photoelectrons e from the electronic repeller electrode 57 by a photoelectric effect. In other words, with respect to the electrons which collide with the grid electrode 2, the electrons corresponding to $1/10^7$ of the current are generated from the electronic repeller electrode 57. Flowing of the ions into the electronic repeller electrode 57 and the generation of the electrons from the electronic repeller electrode 57 are in the same direction as the direction of the electrometer 50, so that a value corresponding to the current according to the X-ray photoelectric effect, namely a spurious pressure is shown. This is a phenomenon which occurs even if the ions do not flow (gas molecules are eliminated) into the electronic repeller electrode 57.

It was first found in the U.S. in the 1940s that this phenomenon results from the fact that the pressure indicated by a triode type (a hairpin filament, a cylindrical spiral grid electrode, and a cylindrical collector surrounding it) ionization vacuum gauge does not decrease to $10^{-6}$ Pa or less. To improve it, the conventional BA type ionization vacuum gauges G shown in FIG. 10 and FIG. 12 were provided. This phenomenon is called an X-ray limit of the ionization vacuum gauge. An idea of using the electronic repeller electrode as an ion collector means a return to the same structure as the triode type ionization vacuum gauge. When it is assumed that electron current is Ie=2 mA, the sensitivity of the electronic repeller electrode 57 can be estimated as about S=0.05/Pa. And, when it is assigned to the Equation (1), spurious pressure $P_x$ according to the soft X-ray can be estimated as follows:

$$P_x = I_f/SI_e = (I_e \times 10^{-7}) \div SI_e = 10^{-7} \div S = 2\times 10^{-6}\ \text{(Pa)},$$

and a pressure lower than it cannot be measured.

Besides, a second problem involved when a total pressure is measured by the electronic repeller electrode 57 is that positive ions (such as alkali metal ions) j generated from the hot cathode filament 3 cannot be prevented from entering the electronic repeller electrode 57 because the hot cathode filament 3 is present in an ion generation space c. The positive ions j generated from the hot cathode filament 3 are also ions not related to the pressure, and even if their generation eliminates the gas molecules, the value indicated by the electrometer 50 does not decrease because of the entry of the ions. Meanwhile, the positive ions j generated from the filament cannot enter the grid inside in the grid electrode 2 in view of the electric potential, so that the total pressure measuring method using the conventional total pressure measuring electrode 5' of FIG. 10 does not have a problem of the positive ions j generated from the filament.

As apparent from the description about the problem of measuring the pressure in the vacuum device 9, the measurement by the conventional quadrupole mass spectrometers Q', Q" is limited to a relative proportion among the gas components of the residual gas, namely the partial pressure only, and it is quite difficult to determine its absolute value. To assist it, another ionization vacuum gauge G for accurately determining the absolute pressure of the whole is required. Especially, the existing vacuum device 9 used at a pressure of ultrahigh vacuum of $10^{-5}$ Pa or less required the measuring devices such as both the quadrupole mass spectrometer Q' or Q" and the ionization vacuum gauge G. For the quantitative analysis of the partial pressure, it was necessary to perform the qualitative gas analysis by the quadrupole mass spectrometer and disperse the value obtained from the ionization vacuum gauge to the ratio obtained by the quadrupole mass spectrometer.

But, even if both the measuring devices are mounted on the same vacuum system 9, outgassing speeds from the two devices difference largely between the quadrupole mass spectrometer Q' or Q" and the simple-structured ionization vacuum gauge G in an ultrahigh vacuum region of $10^{-7}$ Pa or less, so that the obtained partial pressure and total pressure often indicate largely different values. Therefore, even if two measuring devices were prepared, there were problems that their functions could not be exerted sufficiently, and mounting two of them was uneconomical.

[Patent Document 1]

Japanese Patent Laid-Open Publication No. Hei 7-037547

The problems to be solved by the present invention are as follows:

(1) In a case where a pressure is measured with the total pressure measuring electrode, sensitivity is variable in a pressure region or by fine adjustment of the electric potential between the electrodes within the ion source.

(2) In a case where a pressure is measured by means of the total pressure measuring electrode, a measuring limit remains at $10^{-5}$ Pa due to the leak current between the electrodes.

(3) In a case where a pressure is measured by means of the total pressure measuring electrode, a problem of quadrupole fringe field occurs.

(4) In a case where a total pressure is measured by means of the electronic repeller electrode, an X-ray limit is high.

(5) In a case where a total pressure is measured by means of the electronic repeller electrode, a disturbance is caused by positive ions from the filament.

(6) In a case where a total pressure is measured by means of conventional quadrupole mass spectrometers, all the measuring limits are about $10^{-6}$ Pa.

(7) In a case where a pressure of the vacuum device is measured, both the quadrupole mass spectrometer and the ionization vacuum gauge are required.

(8) There is a difference between a value obtained by measuring the total pressure with the ionization vacuum gauge and a total value obtained by measuring the partial pressure with the quadrupole mass spectrometer.

The present invention has been made to solve the above-described problems (1) to (8).

SUMMARY OF THE INVENTION

Specifically, the present invention provides a quadrupole mass spectrometer which can perform high precision pressure measurement and high precision quantitative gas analysis by newly providing a total pressure measurement electrode within a grid electrode which forms the ion source of the quadrupole mass spectrometer and adding means for switching the electric potential of the electrode.

In addition, the total pressure measurement electrode is added and means for switching the electric potential is added, thereby to provide the same condition as a case where the total pressure measurement electrode is not provided, so that it makes it possible to measure an absolute pressure under a lower pressure.

The present invention also provides a quadrupole mass spectrometer capable of performing highly reliable total pressure measurement by providing an insulating structure between the ion source electrodes so as not to generate leak current in the total pressure measuring electrode.

Further, the present invention provides means capable of disusing the ionization vacuum gauge by limiting to only a quadrupole mass spectrometer for pressure measurement to be mounted on a single vacuum device.

The present invention relates to a quadrupole mass spectrometer, comprising an electron impact ion source in which a demarcation space is formed of at least a grid electrode and an ion focusing electrode within a vacuum device, electrons emitted from an electron emitter which is disposed outside of the grid electrode are accelerated toward the grid electrode, gas molecules flying into the demarcation space are ionized in a process that the accelerated electrons pass through the mesh of the grid electrode and then continue to oscillate in and out, and the ionized ions are emitted as an ion beam to outside of the demarcation space through a hole formed in the center of the ion focusing electrode; a quadrupole mass analyzing portion which separates the ion beam obtained from the ion source depending on a charge-to-mass ratio of the ions; and a detector which catches an ion beam according to the mass separated through the quadrupole mass analyzing portion and converts it into an electric current signal, wherein partial pressure strength according to a gas type in the vacuum device is measured from an ion current intensity to be obtained, and a total pressure measurement electrode for examining an ion density is disposed in the demarcation space which is formed of the grid electrode and the ion focusing electrode.

Thus, the total pressure measurement electrode is newly provided in the demarcation space within the ion source, so that the ions generated in the demarcation space which is formed of the grid electrode and the ion focusing electrode are divided at a ratio of n to 1−n, the former is measured for a total pressure, and the latter is measured for a partial pressure, and the ion current which is obtained by using the same grid electrode and hot cathode filament without mutually influencing in the total pressure measurement and the partial pressure measurement is measured. Thus, the existing problems can be solved all at once, and the quantitative pressure measurement within the vacuum device can be performed with high accuracy.

According to the present invention, the total pressure measurement electrode is preferably formed to the shape of a needle and inserted into the grid electrode to a length of ¼ to ½ in its cylindrical direction, thereby if becomes possible to take 90% to 95% (n=0.9 to 0.95) of the total amount of the ions, which are generated in the demarcation space within the grid electrode, into the total pressure measurement electrode. Accordingly, the same high precision total pressure measurement as the conventional ionization vacuum gauge can be provided.

More preferably, by switching the total pressure measurement electrode from the electrometer which is held at the ground potential to the electric potential of the grid electrode, the positive ions generated in the demarcation space are not caught by the total pressure measurement electrode, so that all the ions flow toward the ion focusing electrode, and it becomes possible to greatly improve the sensitivity of the quadrupole mass spectrometer.

In addition, the necessity of the total pressure measuring electrode is eliminated, so that the problems of the quadrupole fringe field is removed, and high precision mass analysis becomes possible.

Further, the present invention relates to a quadrupole mass spectrometer, comprising an electron impact ion source in which a demarcation space is formed of at least a grid electrode and an ion focusing electrode within a vacuum device, electrons emitted from a hot cathode filament which is disposed outside of the grid electrode are accelerated toward the grid electrode, gas molecules flying into the demarcation space are ionized in a process that the accelerated electrons pass through the grid electrode and then continue to oscillate in and out of the grid electrode, and the ionized ions are emitted as an ion beam to outside of the demarcation space through a hole formed in the center of the ion focusing electrode; a quadrupole mass analyzing portion which separates the ion beam obtained from the ion source depending on a charge-to-mass ratio of the ions; and a detector which catches an ion beam according to the mass separated through the quadrupole mass analyzing portion and converts it into an electric current signal, wherein in the quadrupole mass spectrometer for measuring a partial pressure strength according to a gas type in the vacuum device from a strength of the ion beam to be obtained, means disposing a total pressure measuring electrode, which has a hole smaller than the diameter of the hole formed in the center of the ion focusing electrode, between the ion focusing electrode and the quadrupoles, and the total pressure measuring electrode is electrically insulated and fixed by fixing bodies which are held at a ground potential and not contacted to an insulator which is in contact with a positive electric potential.

Thus, the present invention can improve the precision of measurement of the total pressure by the conventional structure without newly adding a total pressure measurement electrode within the demarcation space which is comprised of the grid electrode and the ion focusing electrode.

Specifically, it is adequate by preventing leak current from occurring at an insulation mounting portion of the total pressure measuring electrode in which the hole for passing the ion beam is formed, so that as a method of preventing it, insulating ceramic which supports the total pressure measuring electrode is prevented from coming into contact with a portion having electric potential higher than the ground potential, thereby preventing the leak current from passing to the ceramic. To make it possible, the mounting part of the ceramic insulating portion is separated from the grid electrode and the ion focusing electrode and held with screws or ceramic which is held at the ground potential (a potential difference does not occur), so that the problem can be solved.

Moreover, the present invention is a vacuum device, comprising means which has a demarcation space formed of at least a grid electrode and an ion focusing electrode and measures a molecular density of residual gas molecules in the vacuum device; an electron impact ion source in which a total pressure measurement electrode for examining an ion density is disposed within the demarcation space which is formed of the grid electrode and the ion focusing electrode to accelerate electrons emitted from an electron emitter which is disposed outside of the grid electrode toward the grid electrode, to ionize gas molecules flying into the demarcation space in a process that the accelerated electrons continue to oscillate in and out of the grid electrode and to emit the ionized ions as an ion beam to outside of the demarcation space through a hole formed in the center of the ion focusing electrode; a quadrupole mass analyzing portion which separates the ion beam obtained from the ion source depending on a charge-to-mass ratio of the ions; and a detector which catches an ion beam according to the mass separated through the quadrupole mass analyzing portion and converts it into an electric current signal, wherein only a quadrupole mass spectrometer which measures a partial pressure strength according to a gas type in the vacuum device from an ion current intensity to be obtained is mounted, and an ionization vacuum gauge other than the quadrupole mass spectrometer is not provided.

In other words, when a measuring device, which is attached to a single vacuum device and measures a residual gas density (pressure), is desired to be a single one, it must be provided with both functions of measuring a total pressure and a partial pressure. Therefore, it is necessary to newly devise a total pressure measuring mechanism for the quadrupole mass spectrometer, and its devising function must be a mechanism exercising the ability equal to or higher than that of an ionization vacuum gauge which is a conventional total pressure measuring device. This type of ionization vacuum gauge heretofore used most extensively is a BA type ionization vacuum gauge, so that by combining this function with the quadrupole mass spectrometer, and by synergistic effects provided by combining, the functions higher than the conventional functions can be exerted by the quadrupole mass spectrometer of the present invention without using the conventional ionization vacuum gauge.

As described above, the quadrupole mass spectrometer of the present invention is provided with a mechanism and a function capable of dividing ion current, which can be obtained from a single ion source, into ions for measuring a total pressure and ions for gas analysis, and performing them with high precision, and realizes the ion source which is configured to prevent the occurrence of leak current and to eliminate background noise (X-ray limit). Thus, it becomes possible to perform the total pressure measurement to the ultrahigh vacuum region lower by three digits or more than the conventional one, and at the same time, the mass analysis of the residual gas quantitatively. Thus, the effect of capability to perform the gas analysis and total pressure measurement of the extreme-high vacuum region can be obtained.

Because it is uneconomical to provide two devices of the total pressure gauge and the quadrupole mass spectrometer within the vacuum device, it is naturally advantageous in view of economy by measuring them at the same time with the total pressure measurement electrode mounted on the residual gas analyzer, and further the effect of not causing an error at all due to variations in ion generation between the total pressure gauge and the residual gas mass spectrometer, can be obtained.

DETAILED DESCRIPTION OF THE INVENTION

Figure 1:
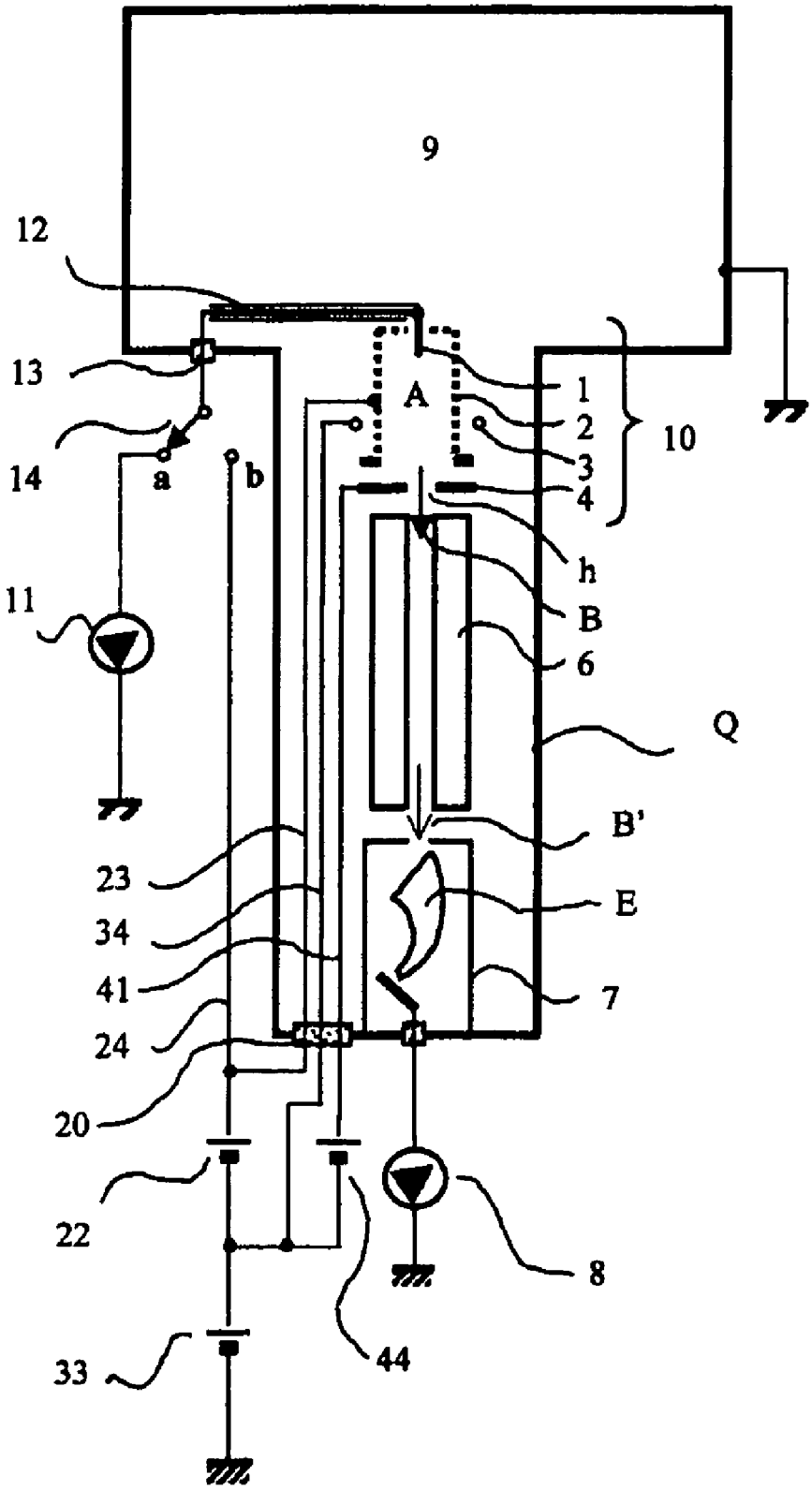
FIG. 1 shows a structure of the quadrupole mass spectrometer with a total pressure measurement electrode of the present invention and a state where it is mounted on a vacuum device.
Figure 2:
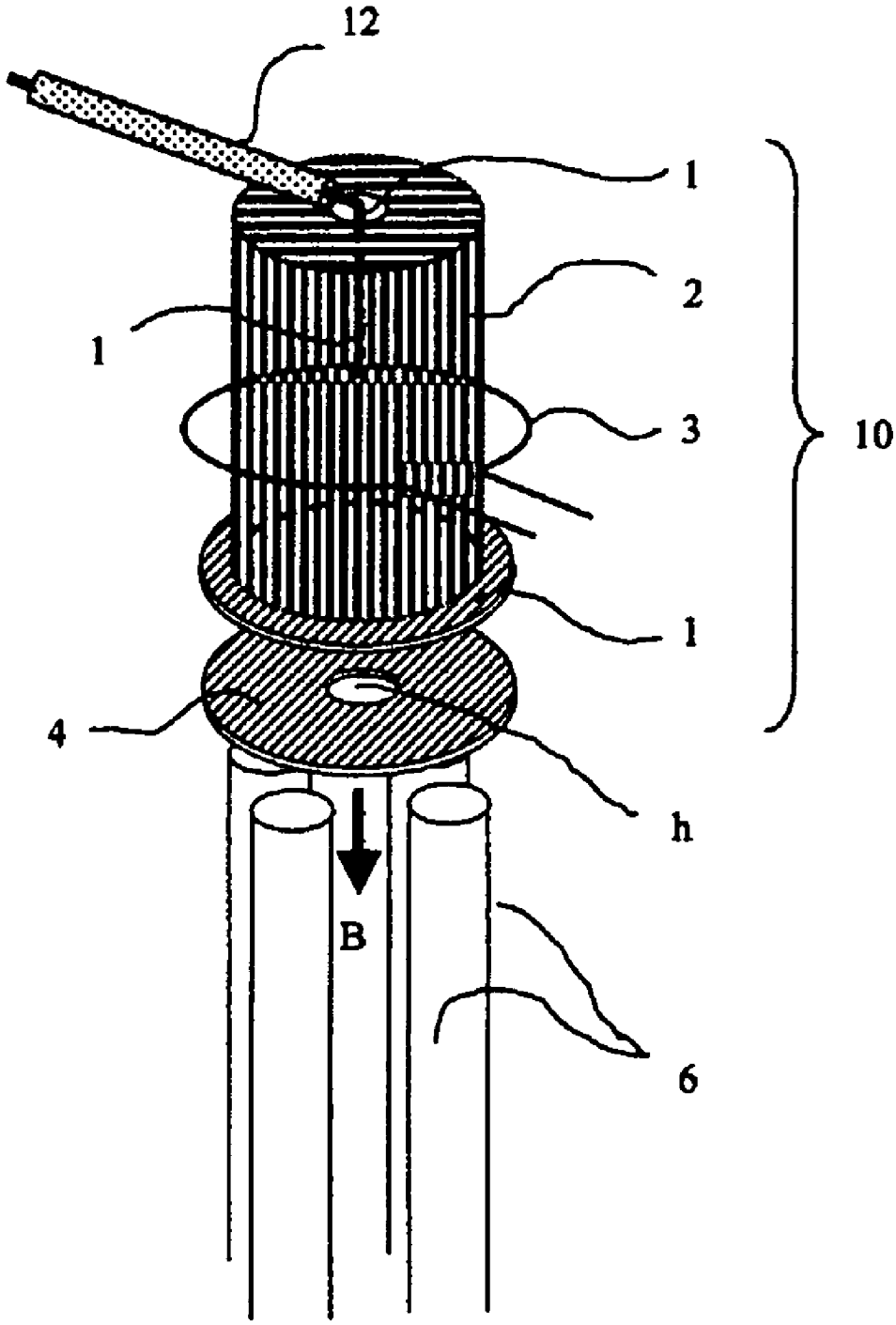
FIG. 2 is a perspective view of the structure of the quadrupole mass spectrometer with a needle shape total pressure measurement electrode of the present invention.

The present invention will be described in detail with reference to the accompanying drawings. FIG. 1 shows an example that only a quadrupole mass spectrometer Q of the present invention is attached to a vacuum device 9. FIG. 2 is a perspective view of the structure thereof.

In this example, a grid electrode 2 constituting an ion source 10 of the quadrupole mass spectrometer Q is a BA type formed into a cylindrical shape by using a wire net having a diameter of 5 to 10 mm and a height of 10 to 20 mm. A demarcation space A is formed by disposing a plate-like ion focusing electrode 4 having a hole of 2 to 4 mm in the center on the side of an open end of the grid electrode 2 and a ring-shaped hot cathode filament 3 is disposed outside of the grid electrode 2.

In the ion source 10, a total pressure measurement electrode 1 of a metal wire (a diameter of 0.1 to 1 mm) is inserted through a mesh or a small hole formed in the wire net portion of the grid electrode 2 which faces the ion focusing electrode 4 into the grid electrode 2 from its edge to a depth of about ¼ to ½ of the grid electrode length. The other end of the wire 1 is mounted on an independent vacuum terminal 13 (FIG. 1) which is held at a ground potential through a shielded electrical lead 12 which is inserted through a ceramic sleeve, and connected to an electric contact switch 14 on the atmosphere side. Where an electric contact switch is selected, the total pressure measurement electrode 1 is connected to an electrometer 11 which is held at the ground potential. Where an electric contact switch b is selected, the total pressure measurement electrode 1 is connected to an electrical lead 23, which applies electric potential to the grid electrode 2, through an electrical lead 24, and the total pressure measurement electrode 1 has the same electric potential as the grid electrode 2. And, the ion focusing electrode 4 draws ions from the demarcation space A while focusing to form an ion beam B.

Figure 3:
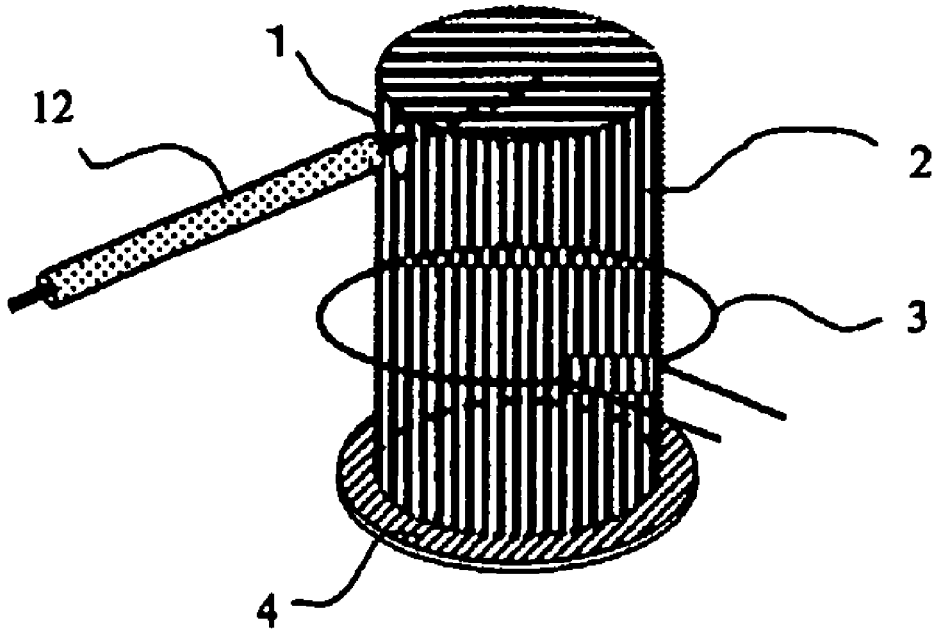
FIG. 3 shows an example of inserting the needle shape total pressure measurement electrode of the present invention into a grid electrode.

As a method of inserting the total pressure measurement electrode 1 from the outside of the cylindrical grid electrode 2 into the demarcation space A, it may be inserted from the side of the grid electrode as shown in FIG. 3.

Figure 4:
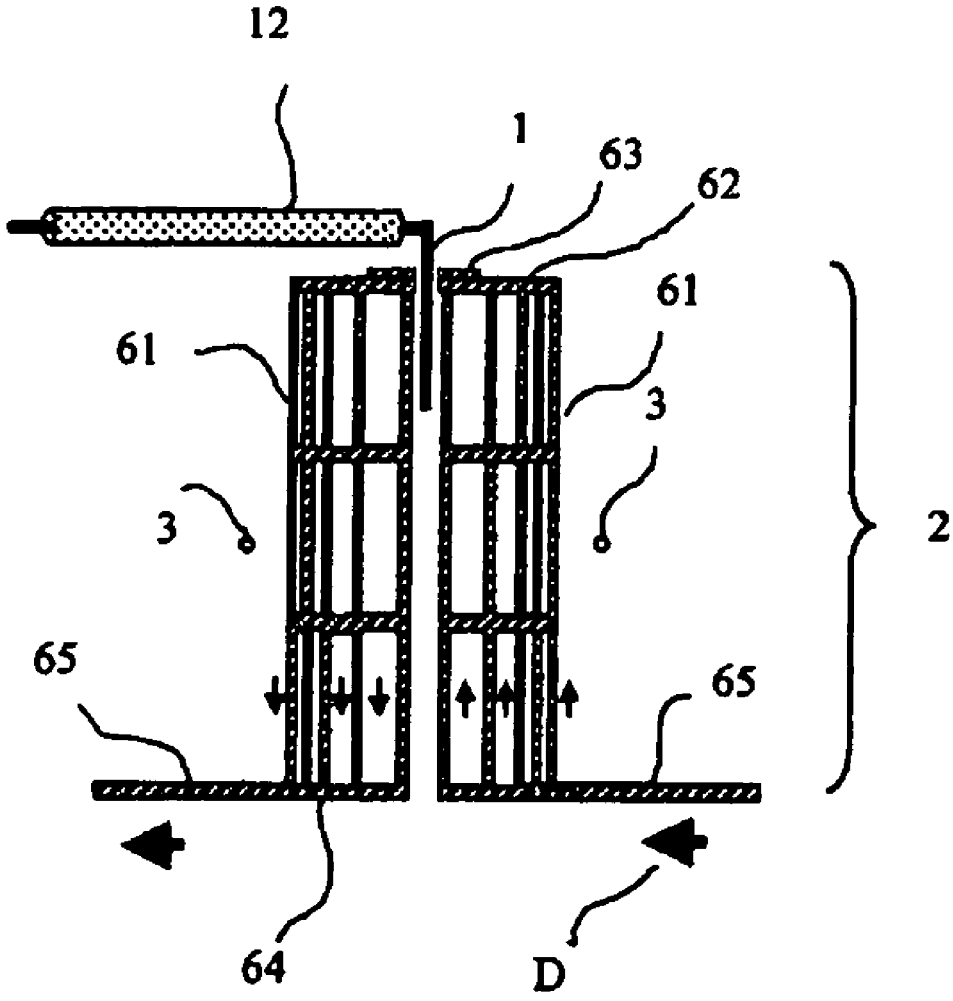
FIG. 4 is a side view showing a combined state of an energizing temperature control type etching lattice grid electrode and a needle shape total pressure measurement electrode.
Figure 5:
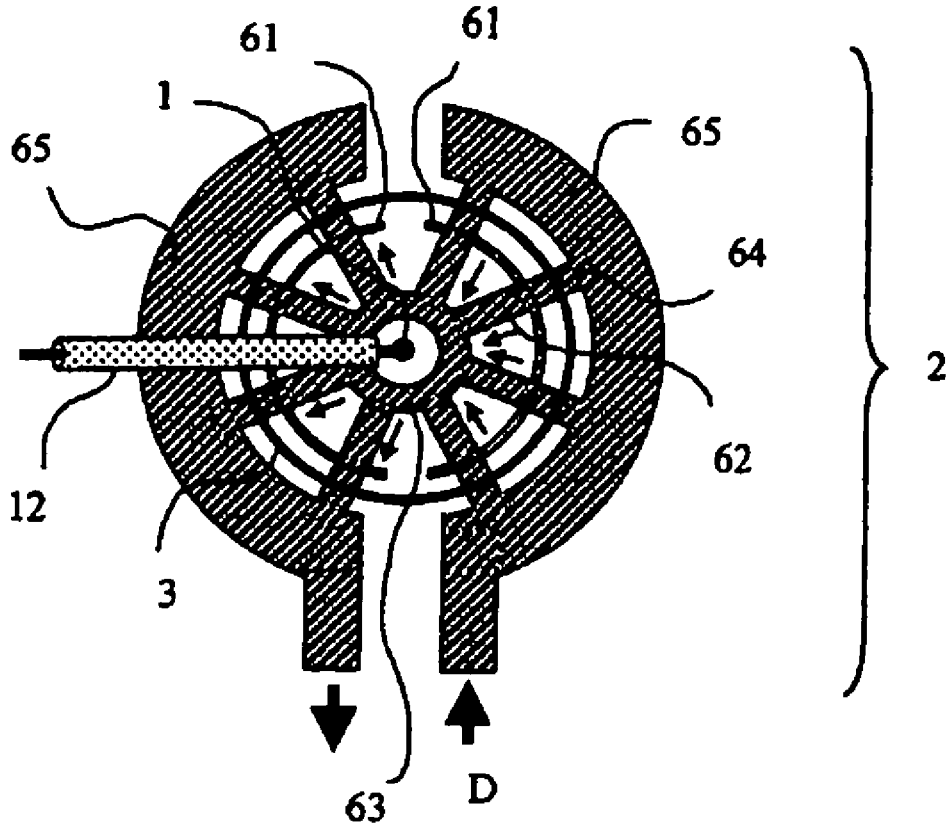
FIG. 5 is a top plan view showing a combined state of an energizing temperature control type etching lattice grid electrode and a needle shape total pressure measurement electrode.

Besides, the grid electrode structure is not limited to the woven mesh but may be formed into a cylindrical grid electrode by making a hole in a plate metal material by a chemical corrosion method or a laser etching method and forming. The grid electrode 2 shown in FIG. 4 and FIG. 5 is formed by forming a thin plate of an alloy of platinum of 80% and iridium of 20% into two woven mesh having four upper and lower tabs by an etching method, forming them into semicylindrical shapes 61, two of them facing to each other, bending upper tabs 62 inward to assemble, and fixing by spot-welding to a small ring 63 formed of the same material. And, lower tabs 64 are bent outward and fixed to semicircular fittings 65 by spot-welding to form the grid electrode 2. Use of the grid electrode 2 provides an advantage that the grid temperature can be controlled by passing current D by assuming that the two semicylindrical grids are two series resistance bodies. In other words, the temperature control makes it possible to exert the ability at the time of analyzing ultrahigh vacuum and extreme high vacuum gases, such as a decrease in outgassing from the grid electrode 2, prevention of gas adsorption by raising the surface temperature, and the like.

Then, a total pressure measuring principle when the electric contact switch 14 is connected to a will be described with reference to FIG. 1 and FIG. 2. The vacuum system 9 is evacuated by a vacuum pump (not shown), and the filament 3 is lit when the pressure becomes $10^{-2}$ Pa or less in which the quadrupole mass spectrometer Q can be operated. Electrons are emitted from the filament 3, and constant electrons of 2 mA flow to the grid electrode. Here, a filament potential 33 is set to 100 V, and the grid electrode electric potential is set to 220 V (filament-to-grid electrode voltage 22 is 120 V). When the ion source 10 is operated in this state, ions are generated at a ratio of about $S=10^{-2}$/Pa in the demarcation space A within the grid electrode. As an ion current, 2 mA is multiplied to obtain $SI_e=2\times10^5$ A/Pa. With the electric contact switch 14 connected to the a side, it is assumed that a ratio of ions taken into the total pressure measurement electrode 1 is n, pressure P which can be measured by means of the electrometer 11 becomes as shown below by modifying the Equation (1):

$$P=Ii/nSI_e$$

where, all n, S, $I_e$ are constants, so that when the constants are once determined under a high pressure, the pressure P can be determined with high precision.

Figure 13:
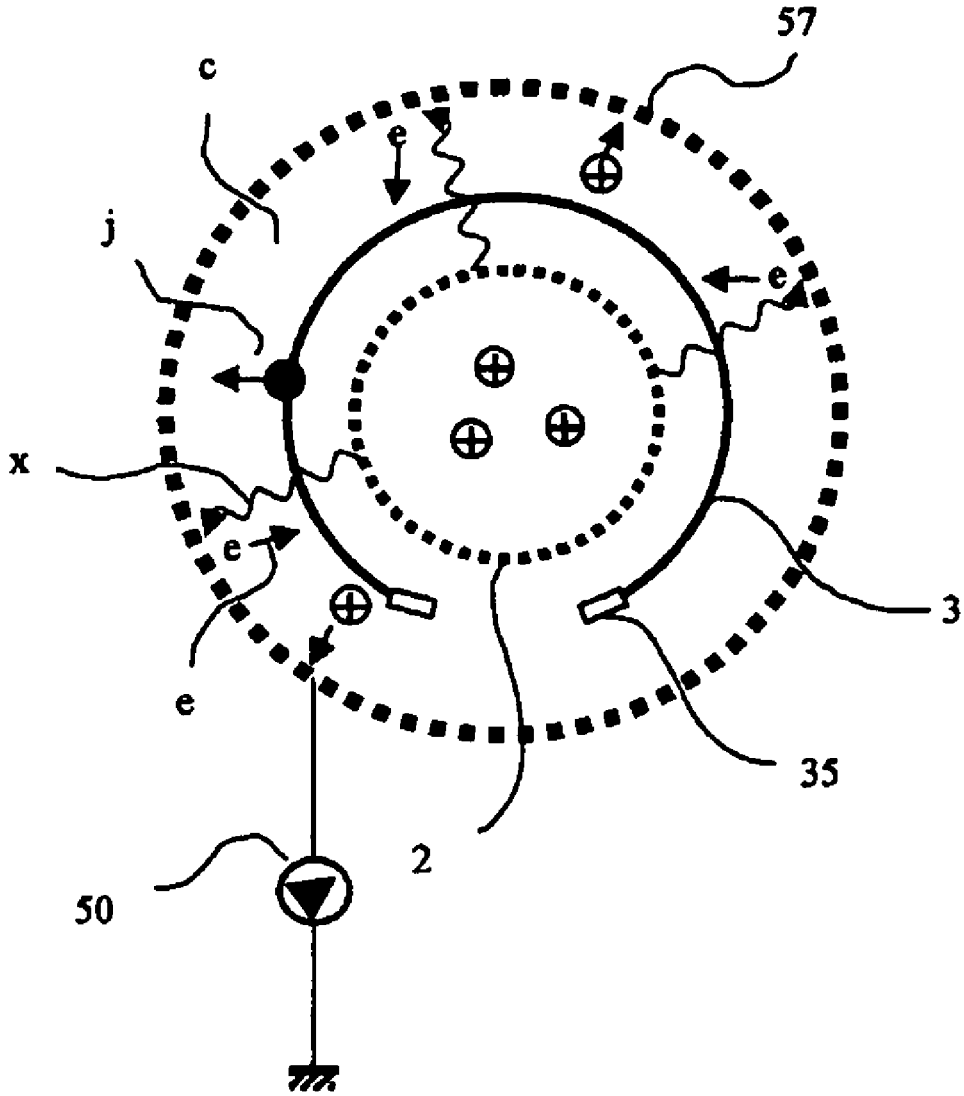
FIG. 13 is an explanatory diagram of problems involved when a conventional electronic repeller electrode is used as a total pressure measurement electrode.

Meanwhile, even the combination of the grid electrode 2 and the needle shape total pressure measurement electrode 1 shown in FIG. 1 and FIG. 2 produces electric current irrelevant of the pressure which is called the above-described X-ray limit at the total pressure measurement electrode 1. But, the total pressure measurement electrode 1 has the shape of a wire, so that incidence probability of the X-ray generated in the grid electrode 2 into the total pressure measurement electrode 1 can be lowered by about 1/500 in comparison with the conventional electronic repeller electrode 57 shown in FIG. 13. Thus, it becomes possible to measure the pressure up to an ultrahigh vacuum. Besides, residual electric current by the X-ray when lowered to 1/500 is constant, and when the offset value is once determined in an ultrahigh vacuum region having a sufficiently low pressure, a circuit for subtracting that value is incorporated into the ion current amplifier, it is possible to prevent the pressure measurement from becoming nonlinear, and to measure the total pressure up to $10^{-9}$ Pa.

When the total pressure measurement electrode 1 is connected to the a side to conduct measuring in FIG. 1, the intensity of the residual ion beam B generated in the demarcation space A becomes $(1-n)SI_e$, and the beam B is sent as the ion beam B to quadrupoles 6 passing through the hole h of the ion focusing electrode 4 at a ratio of $(1-n)SI_e$, divided into ion beam B' according to the mass, amplified by a detecting device 7, and read by an electrometer 7. Similarly, because all n, S, $I_e$ are constants, the relative intensity of the mass spectrum according to the mass becomes constant, and its ratio indicates the partial pressure in the demarcation space A.

Then, the function when the electric contact switch 14 is connected to the b side in FIG. 1 will be described. In this case, the total pressure measurement electrode 1 has the same electric potential as the grid electrode 2, so that ions generated in the demarcation space A cannot enter completely into the total pressure measurement electrode 1. Then, all the ions generated in the demarcation space A flow toward the hole h of the ion focusing electrode 4, and the portion of $SI_e$ becomes ion beams and are sent to the quadrupoles 6. The intensity of the gas analysis spectrum increases at a ratio of $1/(1-n)$ in comparison with the case of the connection to the a side, and the entire intensity can be enhanced without changing the relative intensity between the mass spectra. Because n can be determined previously in a high pressure region with high precision, so that after the ultrahigh vacuum is reached, the intensity of the spectrum is increased by switching the electric contact switch 14 from the a side of which absolute value is known to the b side higher by $1/(1-n)$. Thus, even if the pressure lowers to ultrahigh vacuum, it becomes possible to make quantitative gas analysis of which absolute pressure is known.

Figure 10:
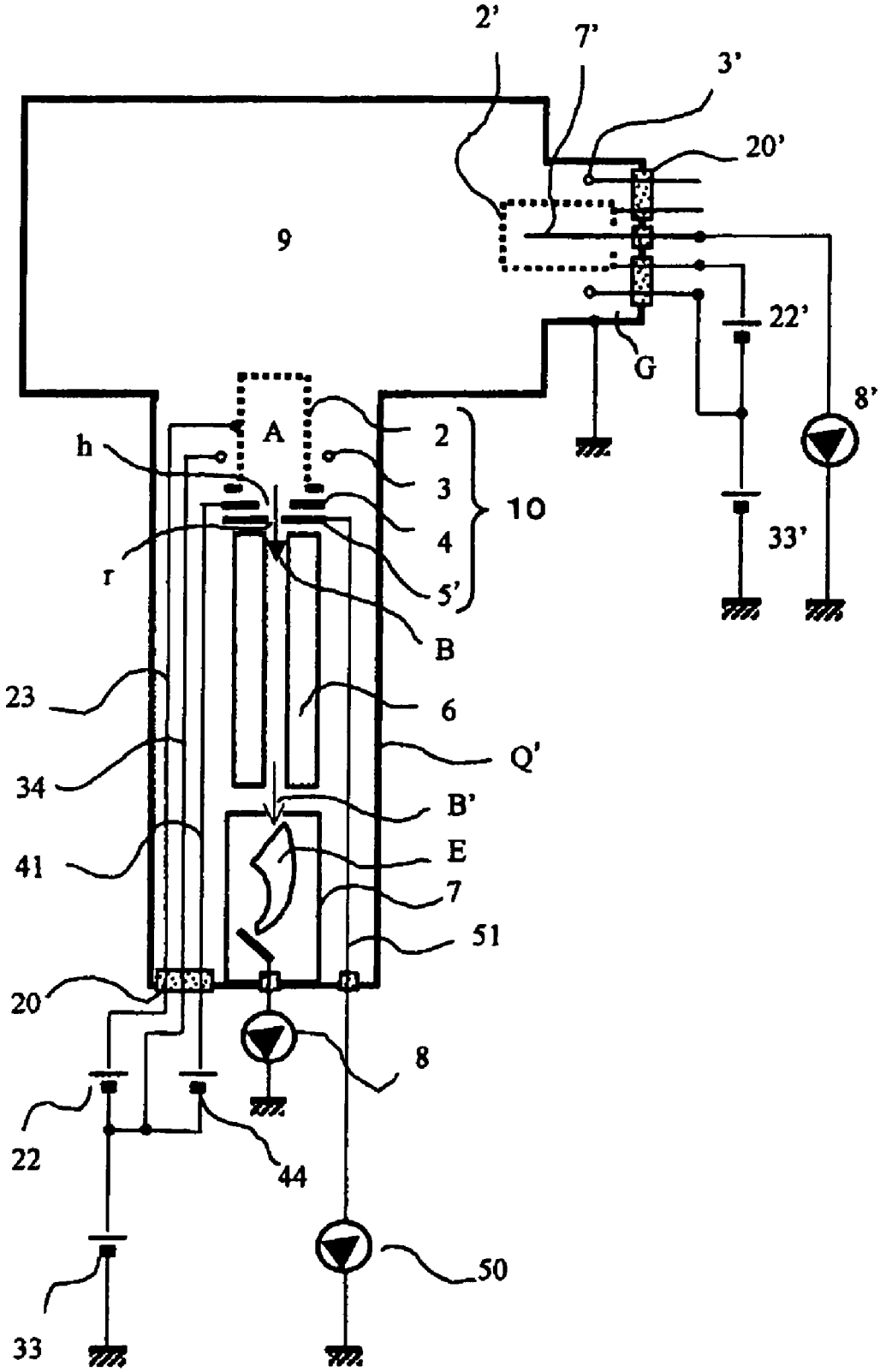
FIG. 10 is a diagram showing a state where a conventional quadrupole mass spectrometer and a conventional total pressure measuring ionization vacuum gauge are mounted on the same vacuum device.
Figure 11:
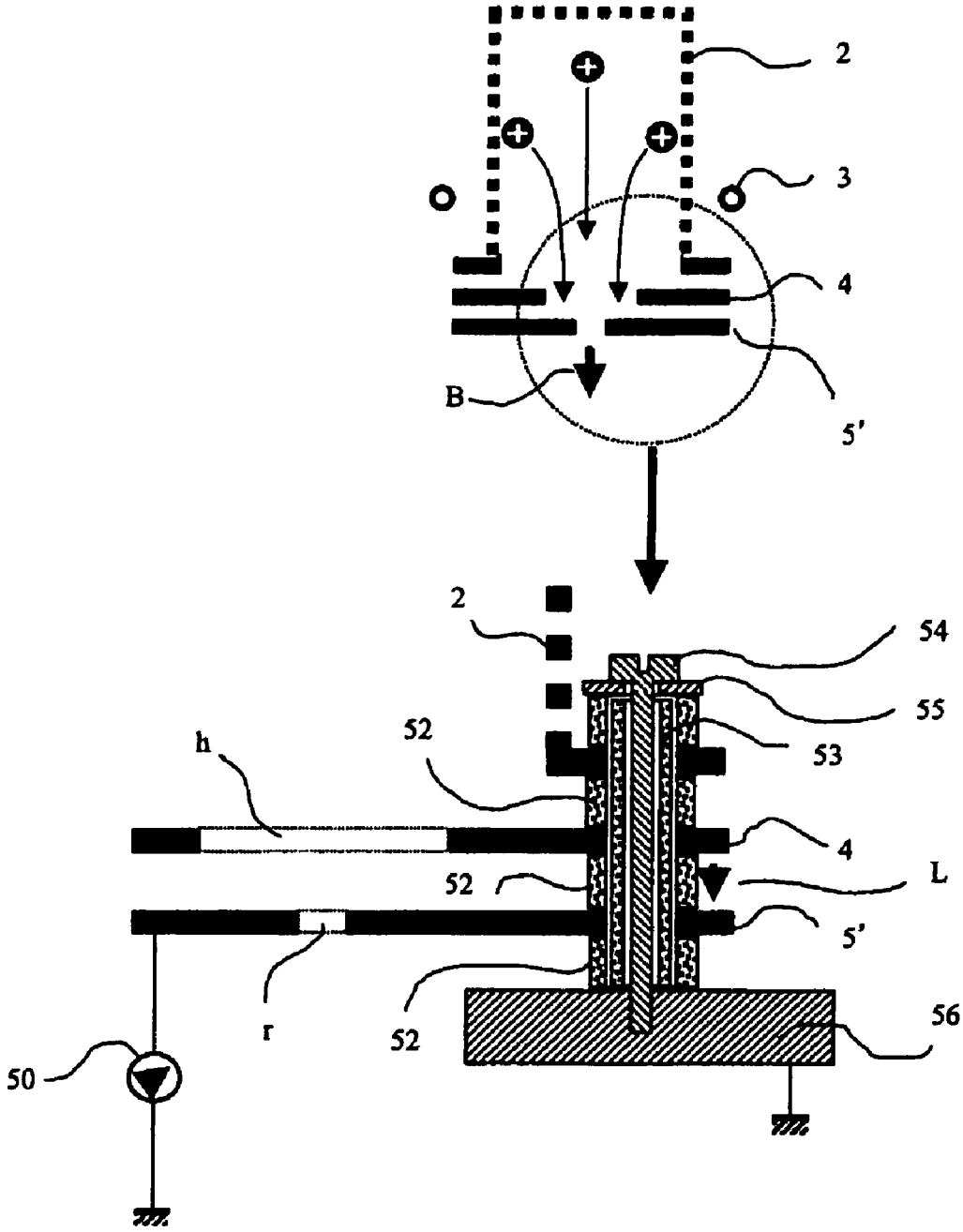
FIG. 11 is a diagram showing an electrode insulation assembled state of a conventional ion source.
Figure 12:
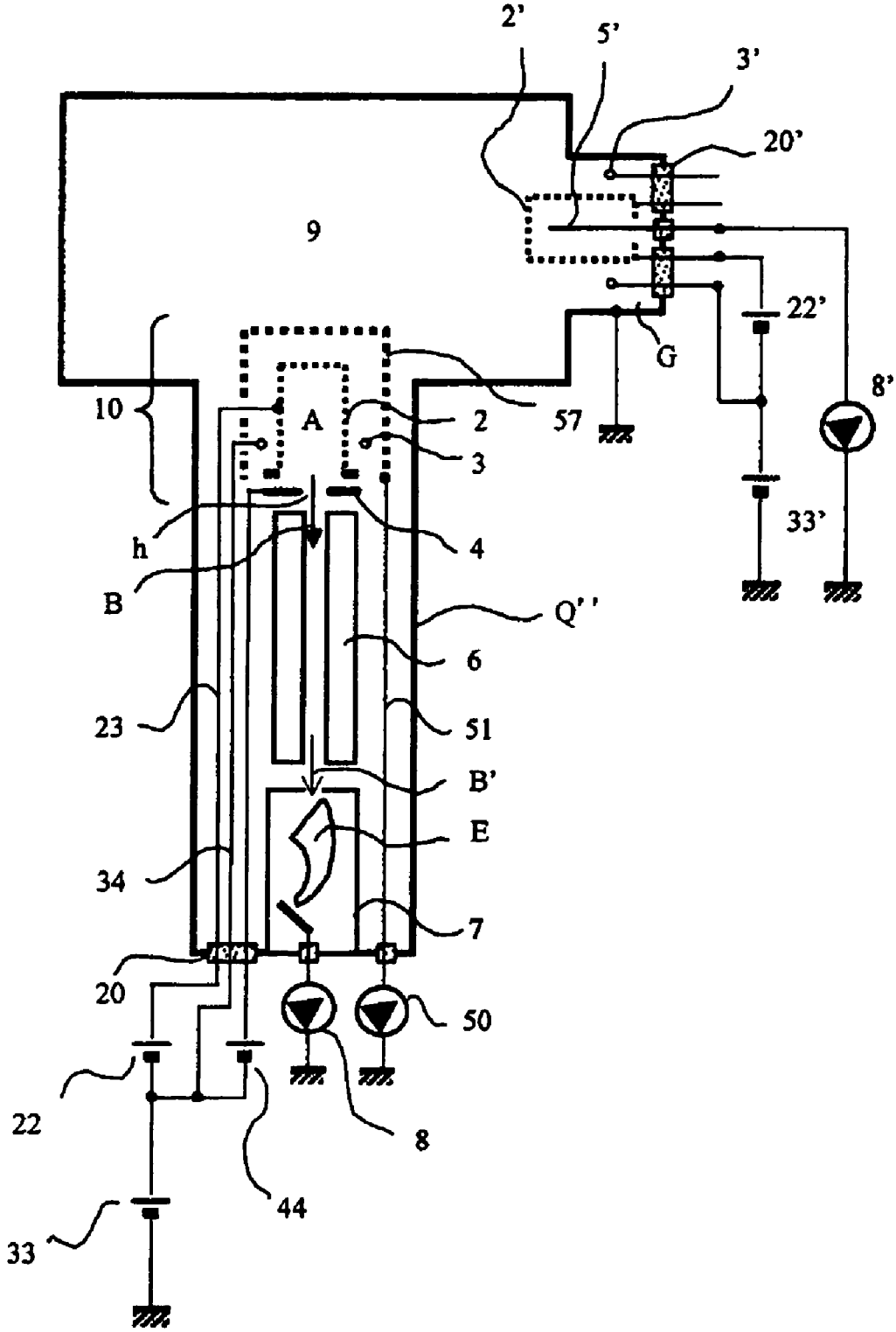
FIG. 12 is a diagram showing a structure of a quadrupole mass spectrometer having a conventional electronic repeller electrode as a total pressure measurement electrode and a state where it is attached to a vacuum device.

Then, the examination results of the embodiment according to the present invention will be described. An embodiment according to the present invention applying the grid electrodes of FIG. 4 and FIG. 5 to FIG. 1 was examined by using the small vacuum system (volume of 1.5 L) shown in FIG. 10.

In this system, evacuation was performed by a magnetic bearing turbo-molecular pump 74 having an pumping speed of 350 L/s and a small composite turbo-molecular pump 75 having pumping speed of 30 L/s which is arranged in its back stage via an all metal valve 73, and finally, a vacuum is formed by a diaphragm pump 76. A nitrogen gas cylinder 78 is connected to a chamber 71 so that pure nitrogen gas can be introduced, and the pressure in the chamber is adjusted by a variable leak valve 77. The pressure can be made in a range of $10^{-9}$ Pa to $10^{-3}$ Pa by an extractor type ionization vacuum gauge (hereinafter referred to as "EXG") and in a range of $10^{-3}$ Pa to $10^{-1}$ Pa by a spinning rotor type viscosity vacuum gauge (hereinafter referred to as "SRG").

Figure 7:
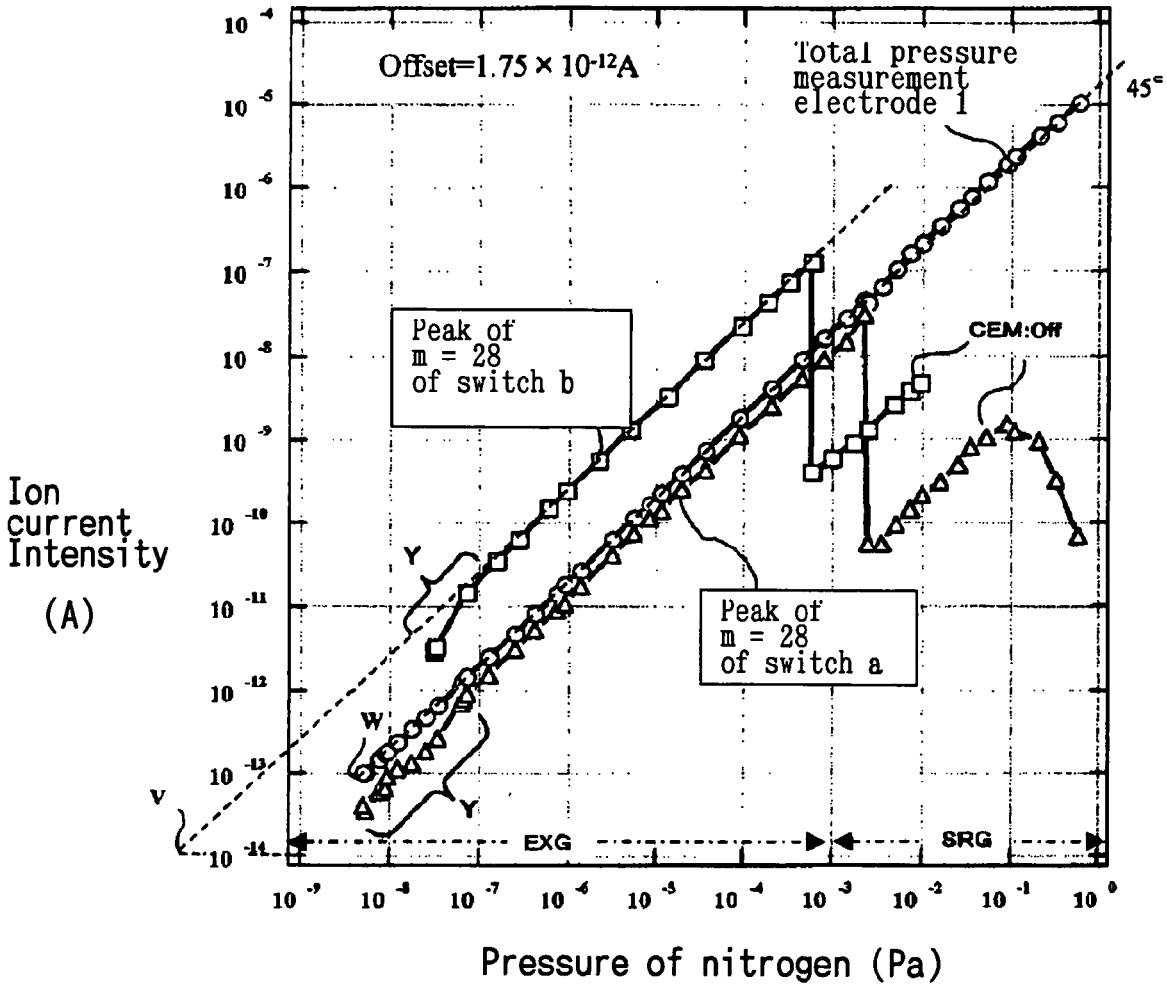
FIG. 7 shows a result of examination of signal outputs with respect to pressure changes of a quadrupole mass spectrometer of the present invention.

The quadrupole mass spectrometer Q having the total pressure measurement electrode of this embodiment was attached to this small vacuum system, and examination was performed. After system has been backed out, the current D flowed to the grid electrode 2 (FIG. 4 and FIG. 5) to heat it to 1000° C. and a degassing was performed. Then, the current D was adjusted to keep the grid at a temperature of 500° C. (to avoid the adsorption of active residual gas), and experiments were performed. Pure nitrogen gas was gradually introduced starting from an ultimate pressure of $5\times10^{9}$ Pa of the EXG, and reading of an the electrometer of the total pressure measurement electrode 1 involved in an increase of a pressure (reading of the EXG) at that time and reading of the electrometer with m=28 which is a peak of nitrogen gas were examined. The results are shown in FIG. 7 by plotting the total pressure by circular marks and the partial pressure by triangle marks on the same graph. In the process, the amplification of a multiplier E was turned off at $3\times10^{-3}$ Pa, and the examination was conducted up to the maximum pressure of 0.8 Pa. Then, the leak valve was closed, the pressure was lowered to $10^{-8}$ Pa, the electric contact switch of FIG. 1 was connected to the b side, nitrogen was introduced again to increase the pressure, and a relation between the pressure and the peak of m=28 was examined. The result is also indicated by square marks on the same graph of FIG. 7.

Soft X-ray generated by the electrons colliding with the grid electrode 2 enters the total pressure measurement electrode 1, and constant residual current (X-ray limit) due to emission of electrons from the total pressure measurement electrode 1 is about $1.75\times10^{-12}$ A, the circular marks plotted on the graph indicates the value obtained by subtracting this value from the entire ion current value. It is apparent from the graph that it was clarified by the present examination that high precision pressure measurement can be performed by the present invention on a straight line which is completely 45° with respect to a change in pressure in a very large range of $10^{-9}$ Pa to 1 Pa at point W (lower limit of the measurement by use of the total pressure measurement electrode 1) on the graph. In other words, a total pressure measuring method for a very wide range of 9 digits, which is superior to a conventional BA type ionization vacuum gauge, can be provided by the present invention.

Here, the reasons that the portion indicated by Y on the curve of triangle marks of m=28 is slightly lower than the straight line are that the main ingredient of the spectrum is hydrogen of m=2 in a reached vacuum, and m=28 overlaps m=28 of nitrogen because of slight remaining m=28 due to carbon monoxide. In other words, m=28 on the graph is output from the quadrupole spectrometer Q, while the EXG uses a hydrogen pressure mainly for the pressure indication. When nitrogen gas is gradually introduced to increase the pressure in the vacuum system 9, hydrogen becomes small relatively, and when the pressure is $10^{-7}$ Pa or more, a proportional relationship is established. Further, when the pressure is $10^{-3}$ Pa or more, the ion current increases. Therefore, when the multiplier E is turned off, the peak intensity of m=28 is kept to have the straight line up to 0.1 Pa, but when the pressure is higher than that, the ions come to collide with the residual gas molecules, and the peak linearity is lost.

The results (indicated by square marks in FIG. 7) obtained when the electric contact switch 14 was switched to the b side in FIG. 1 will be described below. In this case, 100% of the ions generated in the demarcation space A are attracted by the ion focusing electrode 4, so that the peak intensity of m=28 is increased to 26 times, and the total pressure measurement is eliminated. In this case, the peak of hydrogen becomes dominant and deviates from the straight line of the graph in the vicinity of an arrival pressure of $1.8\times10^{-8}$ Pa (not lowering to $10^{-9}$ Pa because nitrogen gas has been introduced). It is important that the straight line of the triangle marks has moved in completely parallel to the straight line of the square marks higher by 26 times when the electric contact is switched from a to b. In a case where a straight broken line of the square marks is extended toward a lower pressure, intersection V with the horizontal axis of $10^{-14}$ A is an extreme high vacuum region of $10^{-11}$ Pa. A principal ingredient of the residual gas of the ultrahigh vacuum or less and the extreme high vacuum is hydrogen, but the pressure lowers gradually from the ultrahigh vacuum while taking substantial time and does not reach the extreme high vacuum instantly. Therefore, in the pressure lowering process, the total pressure measurement electrode 1 of this example can be used to determine in the $10^{-8}$ Pa range a total of spectra indicated by the triangle marks with respect to the total pressure indicated by the circular marks with the electric contact switch on the a side. Then, when the electric contact switch is switched to the b side, a total of spectra of which absolute pressures are found can be switched to a group of spectra indicated by the square marks with the sensitivity enhanced to 26 times. Therefore, the peak value when lowered to $10^{-11}$ Pa of intersection V which is an extension of the lowering curve of the group of spectra indicated by the square marks is a value corresponding to the absolute pressure, indicating that the quantitative partial pressure measurement in the extreme high vacuum region has become possible.

Figure 8:
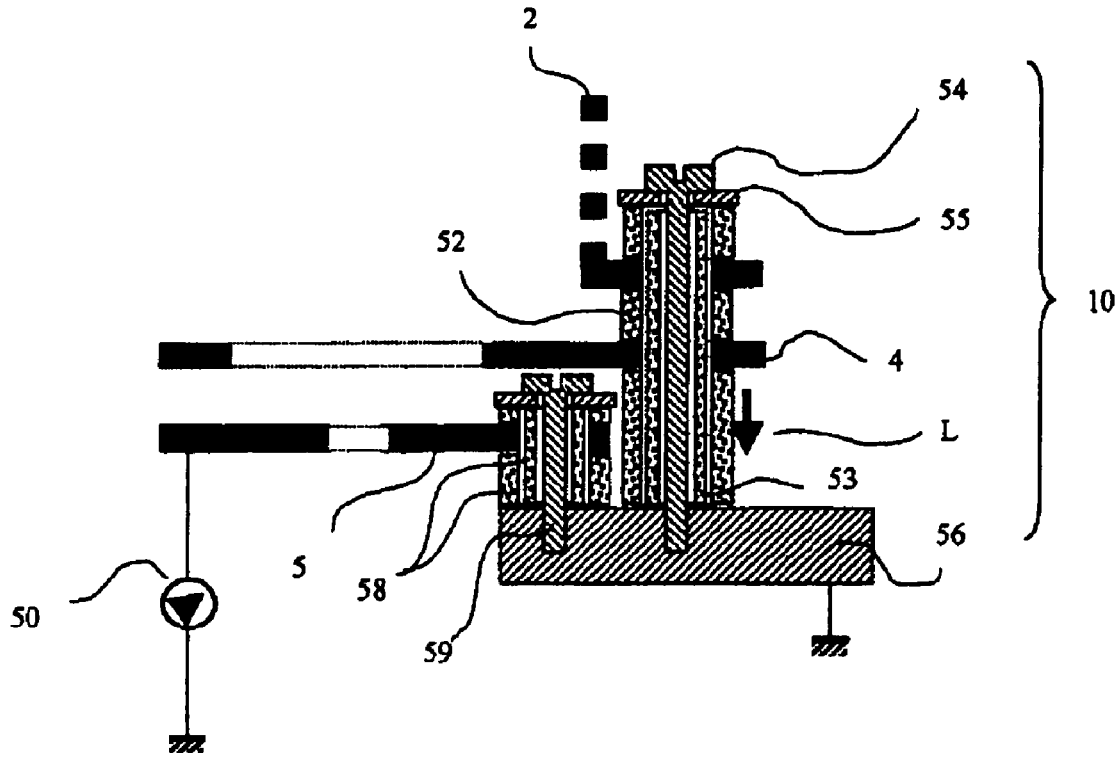
FIG. 8 is a structural diagram of a total pressure measuring electrode of an ion source portion of the present invention.

Another embodiment of the present invention will be described with reference to FIG. 8. A potential difference between the ion focusing electrode 4 and the quadrupole casing 56 of the ground potential is about 200V, and occurrence of leak current L cannot be avoided. As described above, this leak current flows into the total pressure measuring electrode 5, so that the measuring of the total pressure by means of the total pressure measuring electrode 5 is conventionally limited up to $10^{-6}$ Pa range.

Accordingly, the present invention has been devised and solves the problems by the following means. Specifically, for mounting the total pressure measuring electrode 5 to the quadrupole casing 56, it is electrically insulated and mounted with screw bolts 58, 59 which are at the ground potential, completely separated from the insulators 52, 53 which are in contact with positive electric potential, and independently mounted to the quadrupole casing. Thus, leak current L is prevented from flowing to the total pressure measuring electrode 5.

Figure 6:
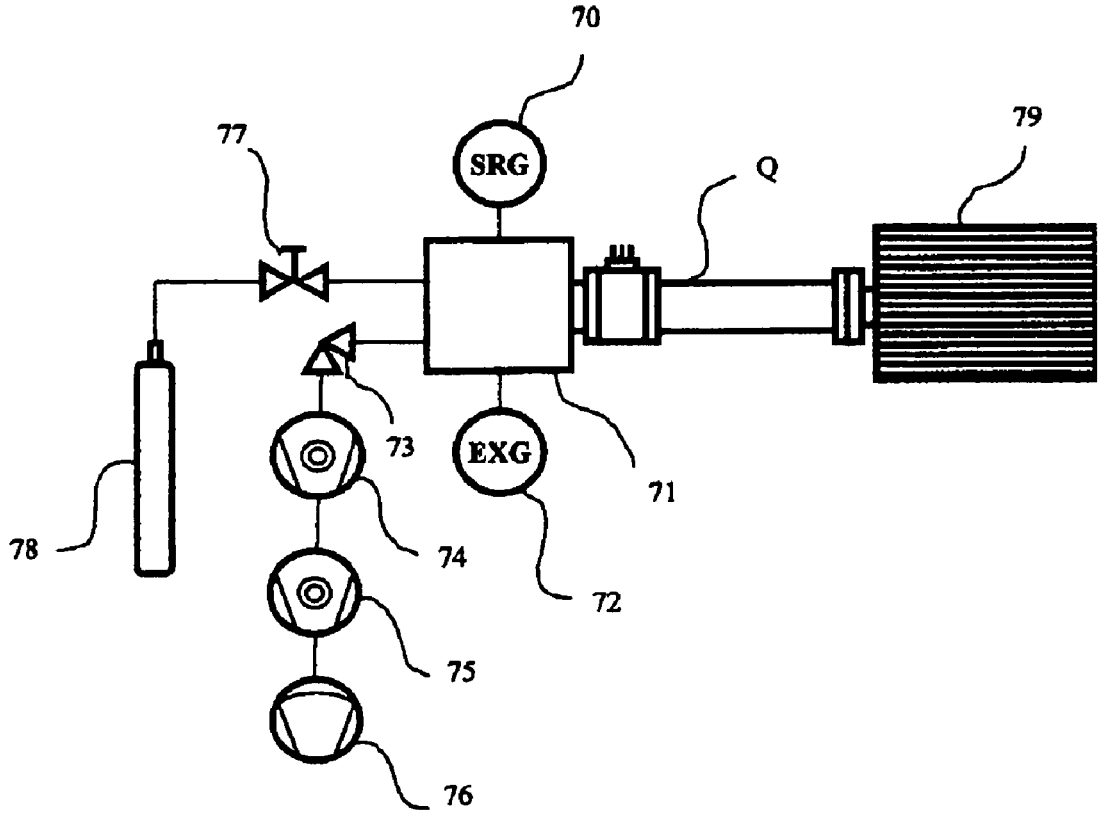
FIG. 6 is a diagram showing a vacuum system for examining, of the present invention.
Figure 9:
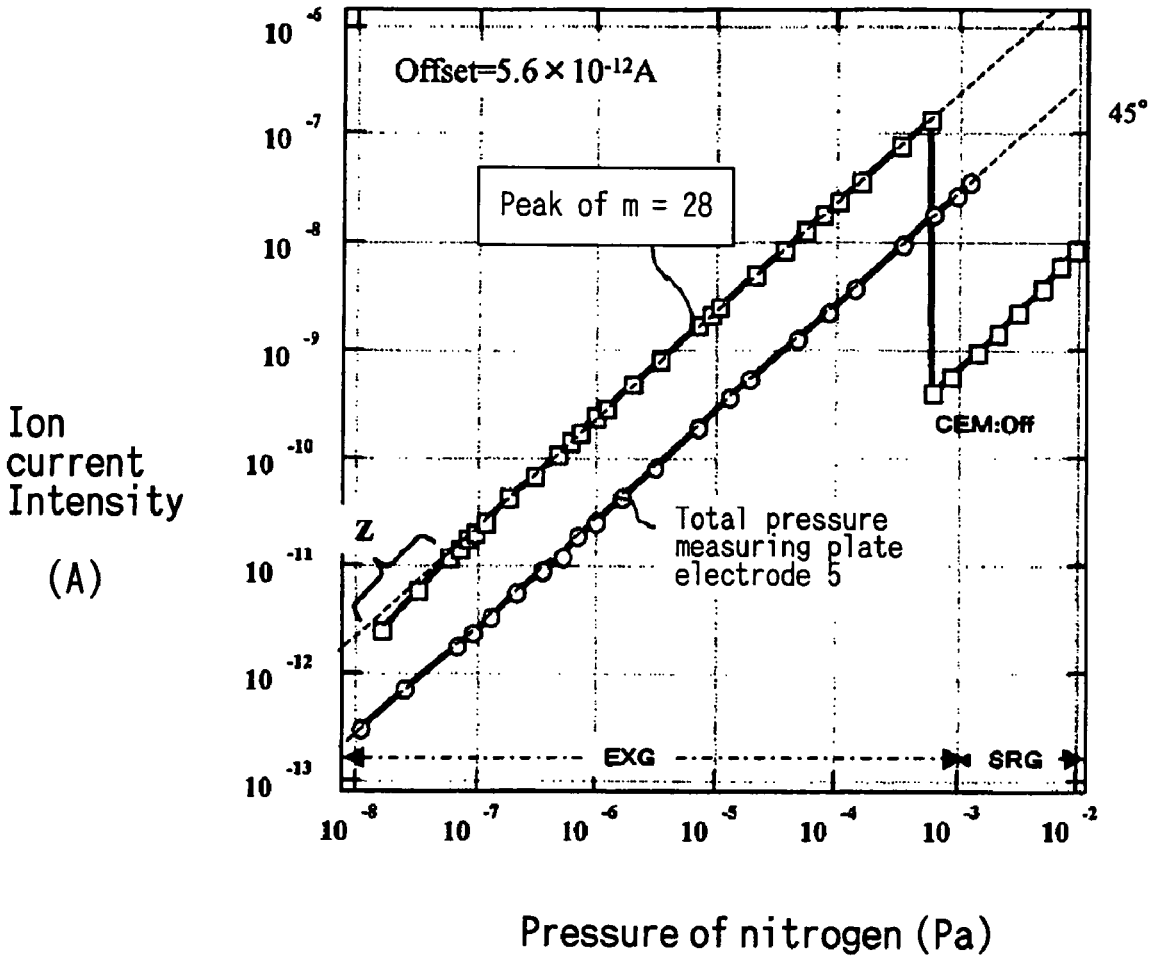
FIG. 9 shows the results of examining signal outputs with respect to pressure changes of the quadrupole mass spectrometer when the total pressure measuring electrode of the present invention is used.

Then, the examination results of another embodiment (mounted state is not shown) according to the present invention will be described. Another embodiment according to the present invention based on FIG. 8 was examined by using the device shown in FIG. 6. FIG. 9 shows circular marks indicating the reading of the total pressure measuring electrode 5 involved in increase of pressures (EXG and SRG readings) and square marks indicating the reading of peak m=28. The X-ray from the grid electrode 2 coming through the hole h of the ion focusing electrode 4 is absorbed by the metal near the ion passage hole r of the total pressure measuring electrode 5, and residual current (X-ray limit) of photoelectrons generated by a photoelectric effect is about $5.6\times10^{-7}$ A. The square marks are plotted with the offset value subtracted. Ion current with respect to a pressure change is indicated as a completely straight line from ultrahigh vacuum of $10^{-8}$ Pa to $10^{-2}$ Pa, indicating that the measurement of a total pressure up to the $10^{-8}$ Pa range has become possible by using the total pressure measuring electrode 5. The reason that the portion Z on the graph deviates to a smaller side from the straight line of the pressure because the main ingredient of the residual gas is hydrogen and the peak value of m=28 becomes relatively small has been described.

Thus, the measuring limit by the conventional leak current was in the $10^{-5}$ Pa range in this embodiment, so that it has become possible to provide the pressure measurement lower by about three digits.

The individual embodiments of the present invention have been described using the hot cathode filament 3 as the electron emitter, but the electron emitter is not limited to it, and a cold cathode emitter such as a Spindt type emitter or a carbon nanotube emitter or ion generation using a laser or another appropriate one can be used.

The total pressure measurement electrode 1 is not limited to a needle shape electrode but may have any shape, such as a conductive small sphere fitted to the tip of a wire, or a ring or a circular plate. There may adopt a method that the hole to be formed in the top of the grid electrode 2 is made to have a large diameter so to take out ions as a beam of the grid electrode 2, to deflect the ion beam and to focus it to the total pressure measurement electrode 1 outside of the grid electrode 2. And, the grid electrode 2 is not limited to the woven mesh but may be one having a hole formed in a plate material by chemical etching, laser punching or the like, or a CIS type which has a slit for entrance of electrons formed on the side of a pipe not having a mesh to allow the electrons enter the pipe body through the slit. And the grid electrode material can be an appropriate one such as stainless steel, molybdenum, tungsten, or platinum alloy. The grid electrode 2 may also be formed by winding a line into a spiral shape. For example, another mechanism may also be incorporated so that the grid electrode temperature can be varied by passing electric current to the grid electrode 2.

In other words, according to the present invention, any structure can be employed for the structure of the electron impact ion source (10), in which the demarcation space (A) is formed of the grid electrode (2) and the ion focusing electrode (4), the grid electrode, by which gas molecules in the vacuum system (9) can form almost the same pressure as the grid electrode, the electrons emitted from the electron emitter (3), which is disposed outside of the grid electrode (2), are accelerated toward the grid electrode (2), the gas molecules flying from the demarcation space (A) are ionized by the accelerated electrons, and the ionized ions are emitted as an ion beam (B) to outside of the demarcation space (A) through the hole (h) formed in the center of the ion focusing electrode (4); wherein in order to divide the ions generated in the demarcation space (A) into a portion of which total pressure is measured and a portion of which partial pressure is subjected to mass analysis by the quadrupoles (6), the ion source (10) has an electrode structure with the total pressure measurement electrode (1) disposed in the demarcation space (A) or the total pressure measuring electrode (5) having a structure that leak current is not generated between the ion focusing electrode (4) and the quadrupoles (6) outside of the demarcation space (A).

The present invention is suitable for a measuring device which is used for analysis of residual gas and pressure of a vacuum system which is used in the semiconductor industry essentially requiring vacuum technology, the film forming industry for various types of thin films, development and production technologies for various products such as surface analyzing apparatus, electron microscopes and the like, and basic research departments for accelerator science and the like.

What is claimed is:

1. A quadrupole mass spectrometer, comprising:

an electron impact ion source in which a demarcation space is formed of at least a grid electrode and an ion focusing electrode within a vacuum system, electrons emitted from an electron emitter which is disposed outside of the grid electrode are accelerated toward the grid electrode, gas molecules flying into the demarcation space are ionized in a process that the accelerated electrons pass through the mesh of the grid electrode and then continue to oscillate to inside and outside of the grid electrode, and the ionized ions are emitted as an ion beam to outside of the demarcation space through a hole formed in the center of the ion focusing electrode;

a quadrupole mass analyzing portion which separates the ion beam obtained from the ion source depending on a charge-to-mass ratio of the ions;

a detector which catches an ion beam according to the mass separated through the quadrupole mass analyzing portion and converts it into an electric current signal; and a total pressure measurement electrode for examining an ion density disposed in the demarcation space which is formed of the grid electrode and the ion focusing electrode, wherein:

partial pressure strength according to a gas type in the vacuum system is measured from an ion current intensity to be obtained.

2. The quadrupole mass spectrometer according to claim 1, wherein the total pressure measurement electrode has one end of a wire inserted into the demarcation space through a hole formed in the grid electrode or the mesh of the grid electrode.

3. The quadrupole mass spectrometer according to claim 1, wherein the total pressure measurement electrode is provided with an electrical lead held outside of the grid electrode, and the electrical lead is electrically shielded to prevent ions generated outside of the grid electrode from entering.

4. The quadrupole mass spectrometer according to claim 1, wherein the total pressure measurement electrode is connected to an insulation vacuum terminal, which is disposed on the wall of a vacuum vessel of the vacuum system, through the electrical lead, and the other end of the insulation vacuum terminal is connected to an electrometer, which is held at a ground potential, in the atmosphere.

5. The quadrupole mass spectrometer according to claim 4, wherein the total pressure measurement electrode is connected to the insulation vacuum terminal, which is disposed on the wall of the vacuum vessel of the vacuum system, through the electrical lead, and the other end of the insulation vacuum terminal can select either of electric potential of an electrical lead for supplying the grid electrode with voltage or the electrometer held at the ground potential by switching an electric contact switch on the atmosphere side.

6. A quadrupole mass spectrometer, comprising:

an electron impact ion source in which a demarcation space is formed of at least a grid electrode and an ion focusing electrode within a vacuum system, electrons emitted from an electron emitter which is disposed outside of the grid electrode are accelerated toward the grid electrode, gas molecules flying into the demarcation space are ionized by the accelerated electrons which have passed through the grid electrode and then continue to oscillate to inside and outside of the grid electrode, and the ionized ions are taken out as an ion beam to outside of the demarcation space through a hole formed in the center of the ion focusing electrode;

a quadrupole mass analyzing portion which separates the ion beam obtained from the ion source depending on a charge-to-mass ratio of the ions; and a detector which catches an ion beam according to the mass separated through the mass analyzing portion and converts it into an electric current signal, wherein:

total pressure measurement in the demarcation space which is formed of the grid electrode and the ion focusing electrode is performed by means having disposed a total pressure measuring electrode, which has a hole smaller than the diameter of the hole formed in the center of the ion focusing electrode, between the ion focusing electrode and the quadrupoles outside of the demarcation space; the total pressure measuring electrode is electrically insulated and mounted by screw bolts which are held at a ground potential but not in contact with an insulator which is in contact with a positive electric potential; and partial pressure strength according to a gas type in the vacuum device is measured from a strength of the ion current to be obtained.

7. A vacuum system, comprising:

means which has a demarcation space formed of at least a grid electrode and an ion focusing electrode and measures a molecular density of residual gas molecules in the vacuum system;

an electron impact ion source in which a total pressure measurement electrode for examining an ion density is disposed within the demarcation space which is formed of the grid electrode and the ion focusing electrode to accelerate electrons emitted from an electron emitter which is disposed outside of the grid electrode toward the grid electrode, to ionize gas molecules flying into the demarcation space in a process that the accelerated electrons continue to oscillate in and out of the grid electrode and to emit the ionized ions as an ion beam to outside of the demarcation space through a hole formed in the center of the ion focusing electrode;

a quadrupole mass analyzing portion which separates the ion beam obtained from the ion source depending on a charge-to-mass ratio of the ions; and a detector which catches an ion beam according to the mass separated through the quadrupole mass analyzing portion and converts it into an electric current signal, wherein:

only a quadrupole mass spectrometer which measures a partial pressure strength according to a gas type in the vacuum system from an ion current intensity to be obtained is mounted, and an ionization vacuum gauge other than the quadrupole mass spectrometer is not provided.

* * * * *